US005413045A

United States Patent [19]

Miszewski

[11] Patent Number: 5,413,045

[45] Date of Patent: May 9, 1995

[54] DETONATION SYSTEM

[76] Inventor: Antoni Miszewski, 10 Boucher Rd., Budleigh Salterton, Devon, United Kingdom, EX9 6JF

[21] Appl. No.: 116,883

[22] Filed: Sep. 7, 1993

[30] Foreign Application Priority Data

Sep. 17, 1992 [GB] United Kingdom ..... 9219666

[51] Int. Cl.[6] ..... F42C 19/00; E21B 43/11

[52] U.S. Cl. ..... 102/201; 166/63

[58] Field of Search ..... 102/201, 200, 275.1, 102/213, 206; 166/297, 55, 63

[56] References Cited

U.S. PATENT DOCUMENTS

| | | | |
|---|---|---|---|
| 3,812,783 | 5/1974 | Yang et al. | 102/201 |
| 4,391,195 | 7/1983 | Shann | 102/201 |
| 4,860,654 | 8/1989 | Chawla et al. | 102/476 |
| 4,862,802 | 9/1989 | Streifer et al. | 102/201 |
| 4,917,014 | 4/1990 | Loughry et al. | 102/201 |
| 5,001,981 | 3/1991 | Shaw | 102/275.1 |
| 5,138,946 | 8/1992 | Soltz et al. | 102/201 |

FOREIGN PATENT DOCUMENTS

WO88/07170 8/1988 WIPO .

*Primary Examiner*—Daniel T. Pihulic
*Attorney, Agent, or Firm*—Herbert Dubno

[57] ABSTRACT

A detonation system 10 particularly suitable for use in subterranean environments, for example in oil exploration and production, uses a detonating device 2 containing explosive material 3. The explosive material 3 is detonated by a pulse of laser light of a pre-determined frequency and power. The laser pulse is sent down a fiber optic line 5 from a laser 6 through an optical splitter 4 which is designed to reflect all frequencies apart from the above mentioned pre-determined frequency. To test the integrity of the fiber optic line a test signal from a second laser 11 is sent down the optical fiber line. The test signal has a different frequency and much lower power and is therefore reflected back along the fiber optic line by the optical splitter where it can be detected. This test signal allows testing while considerably reducing the chances of accidental damage.

15 Claims, 5 Drawing Sheets

DETONATION SYSTEM

FIELD OF THE INVENTION

The invention relates to a detonation system for detonating explosives particularly though not exclusively in subterranean environments, for example, in oil wells for the search and extraction of oil.

BACKGROUND OF THE INVENTION

Explosive charges are regularly used in the oil industry to perforate the metal casing across the reservoirs of oil and gas wells when the well is put into production. Explosives are used because they provide a concentrated energy source which is generally easy to handle.

Currently explosives used in boreholes are detonated by electrical, hydraulic or mechanical means. In electrically detonated systems, the signal and power for detonation are sent by wire to an electrically triggered detonator. It is thereby possible to remotely detonate the explosion. The wire together with the detonator, and possibly a plurality of detonators, form what is known as a firing circuit. The detonation of the devices is achieved by sending a sufficient amount of electrical power along the firing circuit and this is known as firing.

Such electrically detonated systems are susceptible to stray currents and stray radiation commonly referred to as electromagnetic interference and radio frequency interference (EMI/RFI) which can cause premature firing, or failure of the transmission of the signal. It is possible to remotely monitor the condition of the firing circuit before firing by using a test signal of a different magnitude. However this carries a risk that the test signal may in fact cause firing because the difference in magnitude between the detonation and test signals is not sufficiently great. This problem is exacerbated by the susceptibility to electromagnetic and radio frequency interference mentioned above. At present the risks are reduced by shutting down radios and equipment which are the source of stray electrical signals when explosives are in use but this is an expensive exercise on a busy oil platform.

Mechanically and hydraulically detonated systems use a remote mechanical or hydraulic link to a percussion detonator. There are no adverse effects from EMI or RFI but there are limits to the economical distances for the remote detonation. It also generally not possible to test the firing device without at the same time running the risk of detonating the explosive device.

In many of these detonation systems it is necessary to use a primary explosive in order to provide satisfactory detonation of the main, secondary explosive. These primary explosives provide additional handling problems and are characterized by an increased susceptibility to shock and fire.

In addition, with all the above existing detonation systems, there is a constant compromise between the reliability which increases with the ease with which the explosive can be detonated and the operational safety which decreases with the ease with which the explosive can be detonated.

OBJECT OF THE INVENTION

It is an object of the invention to overcome the aforementioned drawbacks.

SUMMARY OF THE INVENTION

According to the present invention there is provided a subterranean detonation system comprising:

at least one detonating means operable to detonate in response to a first predetermined optical signal;

a first optical signal emission means operable to provide the first predetermined optical signal; and transmission means coupled to the detonating means and the first optical signal emission means for transmitting the first predetermined optical signal to the detonating means to actuate detonation of the detonating means. The first optical signal emission means may be operable to provide the first predetermined optical signal at a predetermined power level and frequency. This has the advantage of being both reliable and safe to use due to the specific frequency and energy of the laser source used. In addition it is reliable in the corrosive and high pressure and temperature environment of an oil well.

The detonation system may further comprise a subterranean detonating system comprising; a second optical signal emission means coupled to the transmission means and operable to provide a second predetermined optical signal for coupling to the transmission means; and sensing means coupled to the transmission means and operable to sense the second predetermined optical system signal. The transmission means can be coupled to at least one detonating means via means operable to transmit the first predetermine optical signal and to reflect the second predetermined optical signal whereby the second predetermined optical signal is coupled in the absence of a fault in the transmission means, via the transmission means to the sensing means thus indicating the integrity of the transmission means. The second optical signal emission means may be operable to provide the second predetermined optical signal at a lower power than the first predetermined optical signal and at a different frequency. This has the advantage that the transmission means can be continually monitored at optical power levels which are up to five orders of magnitude less than that required to fire the detonator by using the second predetermined optical signal as a test signal before firing. Because the test signal may be used at a frequency different from the firing signal the test signal is prevented from acting directly on the detonating means. This overcomes the existing problems relating to the risk of detonation during testing which are incurred in particular with electrical systems. This is particularly useful when a large number of explosive devices are used.

The transmission means may be an optical fiber cable which can be used to detonate more than one detonation system simultaneously or sequentially. With previous electrical systems an additional electric cable would be required, if detonation and sensing is required.

BRIEF DESCRIPTION OF THE DRAWING

The above and other objects, features, and advantages will become more readily apparent from the following description, reference being made to the accompanying drawing in which.

SPECIFIC DESCRIPTION

Figure 2:
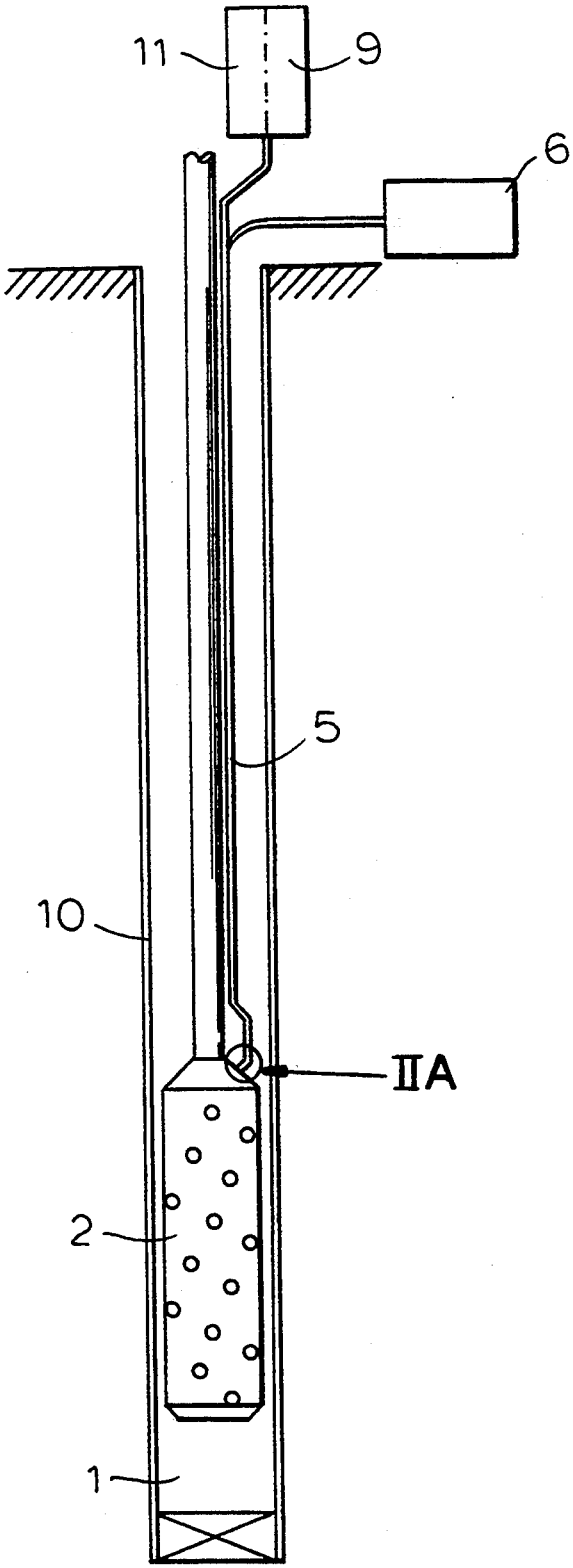
FIG. 2 is a simplified vertical cross section of a first embodiment of an explosive device according to the invention received in a bore hole.
Figure 2A:
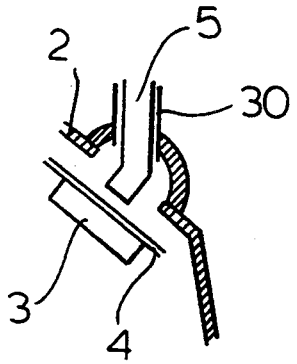
FIG. 2A is a detail view of the region IIA of FIG. 2.

FIG. 2 shows a explosive device 2 positioned down a borehole 1, for example, of an off shore oil field. The explosive device 2 contains a requisite amount of explosive material 3 as in known detonation systems. Provided at an upper part of the explosive device 2 is an optical splitter 4 which is coupled to a fiber optic line 5, comprising an optical fiber, which is in turn coupled to a remotely located laser 6 (see FIG. 2A).

The firing laser 6 provides an optical signal, i.e. a pulse of laser light which is carried along the fiber optic line 5 to the splitter 4. The terms "optical" and "light" as used herein are deemed to include signals having frequencies in both visible and non-visible ranges as may be produced by a laser. The firing laser 6 is selected to provide a laser pulse having a pre-determined detonation frequency and power which is sufficient to detonate the explosive material and thus the explosive device 2. The splitter 4 is chosen to be transmissive to light of this pre-determined frequency and power, but reflective to light of other frequencies. Thus, the splitter 4 allows a light pulse of this pre-determined detonation frequency and power to be emitted by the first laser 6 to impinge on the explosive material 3 and cause detonation, but will reflect other light pulses of different frequencies and prevent them from impinging on the explosive material 3.

A typical laser for firing is a Nd-Yag laser which operates at 1064 nanometers, although, it will be appreciated that other lasers could be used for firing which have different frequencies. A preferred output energy of the laser is in the range of 0.8 to 5 joules. The actual energy required to detonate the explosive device 2 can be as low as 10 milli Joules but the additional power is necessary to compensate for losses in energy during transmission along the fiber optic line 5. The laser used for firing the explosive device is required to be a pulse laser.

The preferred fiber to be used is a silica fibre preferably hard coat silica. A typical size of line would be 200 microns in diameter which is necessary in order to avoid high energy densities which could damage interconnections. The fiber is preferably multi-mode fiber which is more tolerant of bends and couplings than is a single-mode fiber.

The integrity of the fibre optic line 5 can be tested after it has been fitted but before detonation and without any risk of detonation, using a test signal.

The testing signal is provided by a second remotely located laser 11. The second laser 11 is a lower powered laser, with a power of up to five orders of magnitude less than that of the first firing laser 6. The test signal is coupled to the fibre optic line 5 for transmitting down the fiber optic line 5. The test signal is selected to have any frequency other than that used for firing, i.e. the detonation frequency. such that such frequencies will be reflected by the reflector. Because the splitter 4 is chosen to transmit light at the detonation frequency and to reflect light at all, or most other frequencies, the test signal is reflected back along the fiber optic line 5 without reaching the explosive material 3.

The reflected test signal is then detected by a test signal sensor 9, which is also remotely located. Non-detection of the test signal would indicate a fault, for example a break, in the fiber optic line 5. Because the power of the test signal is selected to be less than the detonation signal, the risk of premature detonation is further reduced.

The fiber optic line 5 can be coupled to the first and second lasers, the splitter 4 and the test sensor 9 by any known optical or mechanical coupling. The preferred coupling method is epoxy crimp coupling.

Figure 3:
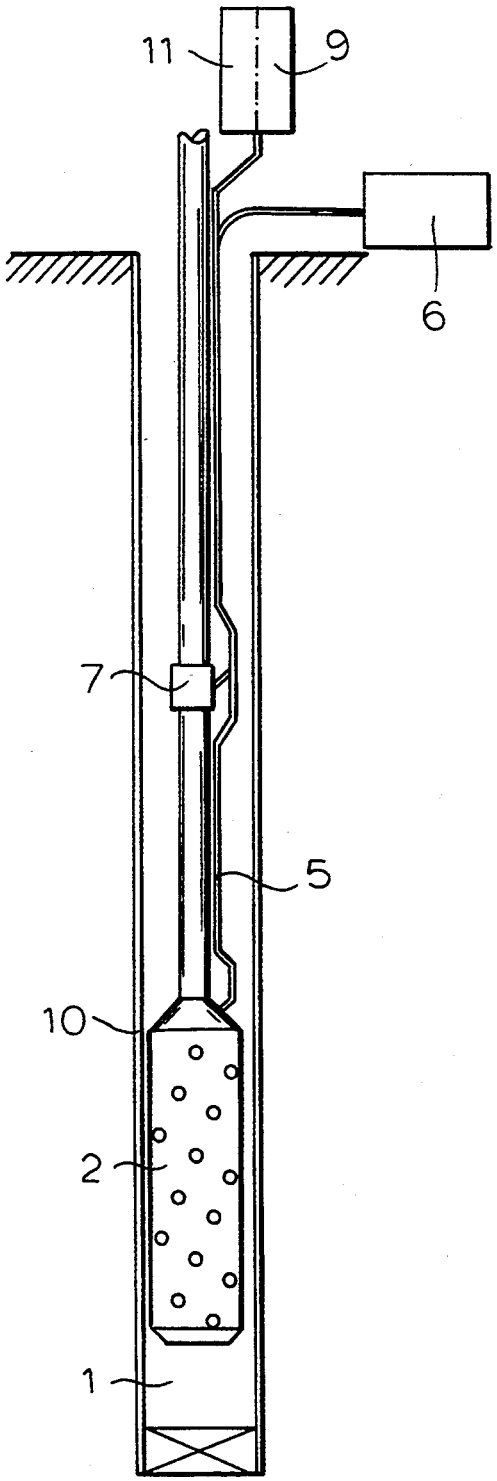
FIG. 3 is a simplified vertical cross section of a second embodiment of a detonation system in accordance with the invention received in a bore hole.

FIG. 3 shows a second embodiment of the invention whereby the detonating system of FIG. 2 also incorporates a sensor 7 for monitoring external operating parameters. Conventional sensors are commonly used in boreholes for sensing pressure, temperature etc, in the surrounding area of the explosive device 2. It is essential to monitor these and other external parameters in order to effectively manage the production from an oil field and to plan the various required drilling operations. The sensor 7 is provided at a suitable location along the fiber optic fiber 5 as shown in FIG. 3. The sensor is of a known type used to monitor these commonly monitored parameters and is coupled to the fiber optic line 5 in any known manner. More than one of these fiber optic sensors 7 may be provided if required. Information from the sensor or sensors 7 is then relayed, for example using the fiber optic line 5 to a remotely located detector 9, for example a printer for use by the operator. Thus by means of fiber optic sensors for these parameters it is possible to use the same explosive firing and testing fiber optic circuit for the monitoring of the general condition of the external environment, for example of an oil well.

The fiber optic sensor 7 is designed to withstand the arduous and uncertain conditions found down a borehole which would typically be up to 20,000 psi. The fiber optic sensor 7 or a number of such sensors can be coupled to the fiber optic line 5 thus considerably reducing the amount of separate cabling required in conventional systems.

Figure 4:
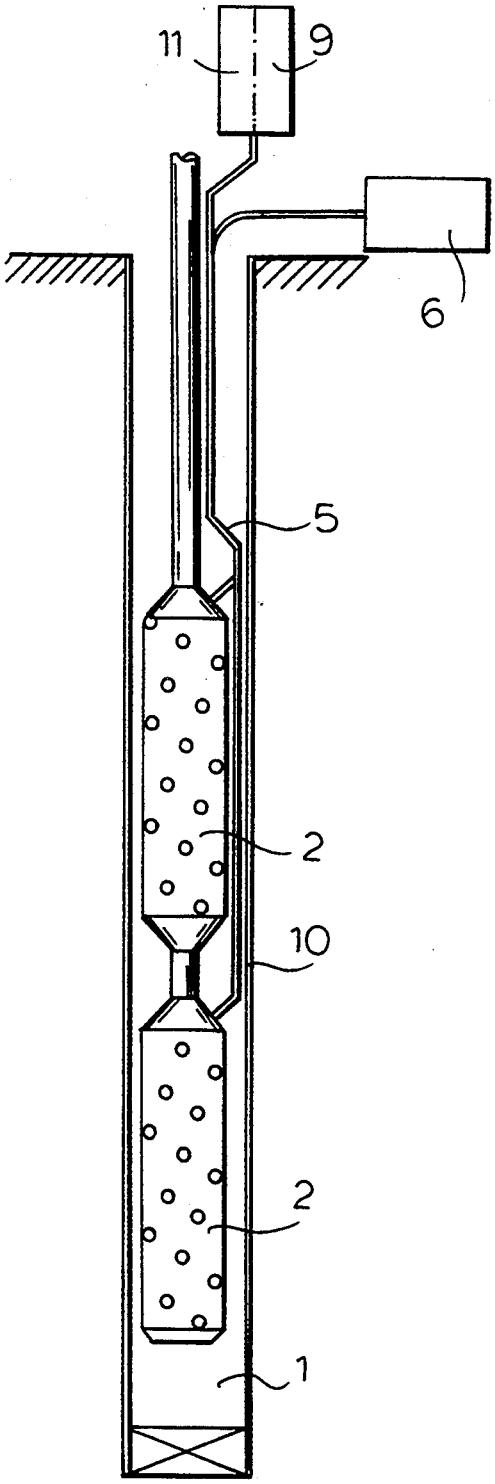
FIG. 4 is a simplified vertical cross section of a third embodiment of a detonation system in accordance with the invention received in a bore hole.

FIG. 4 shows a detonation system incorporating two explosive devices 2, which may be separated from each other by a large distance. The explosive devices 2 are coupled to the same fiber optic line 5 and are therefore detonated at the same time. Optical splitters (not shown) are provided in the fiber optic line 5 at the junctions where the fiber optic line 5 is to be coupled to the explosive devices 2 to direct the laser pulses to the explosive devices 2.

Figure 5:
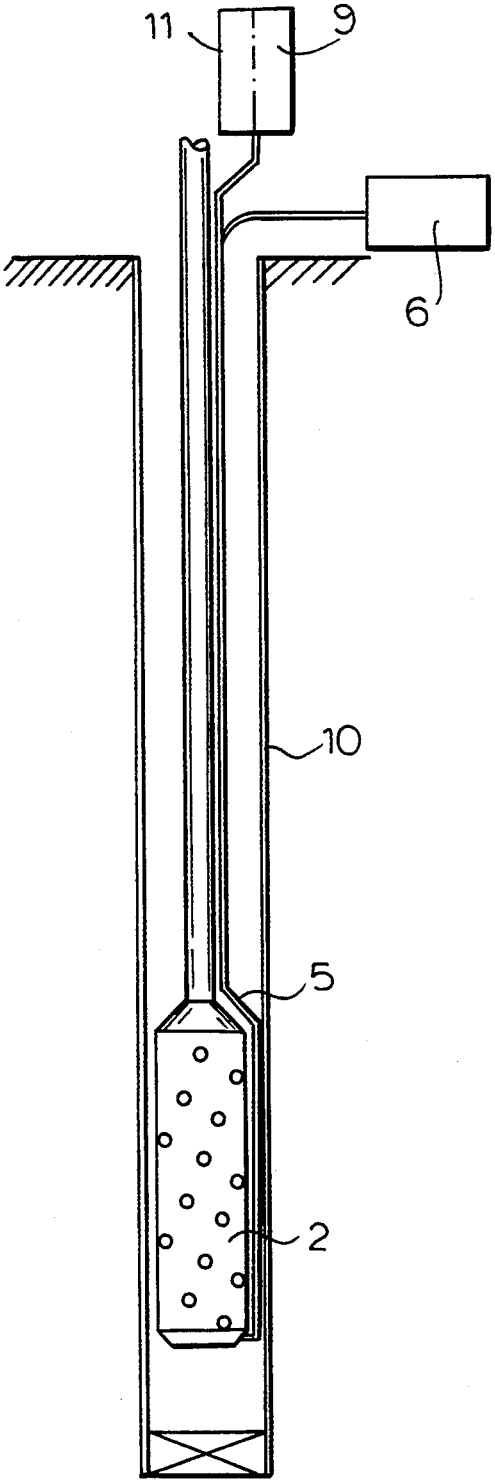
FIG. 5 is a simplified vertical cross section of a fourth embodiment of a detonation system in accordance with the invention received in a bore hole.

FIG. 5 shows an embodiment in which the fiber optic line 5 is coupled to the explosive device 2 at a lower section rather than an upper section as in the previous embodiments. Many detonation systems have explosive devices which incorporate the use of a liquid which flows to the bottom of the explosive device in the event of a leak of other malfunction. In this embodiment illustrated in FIG. 4, the presence of the liquid at the bottom of the explosive device 2 can be detected by coupling the fiber optic line 5 to the bottom section of the explosive device 2. Thus the explosive device can be disarmed in the vent of any malfunction. This is known as fluid desensitization.

Figure 6:
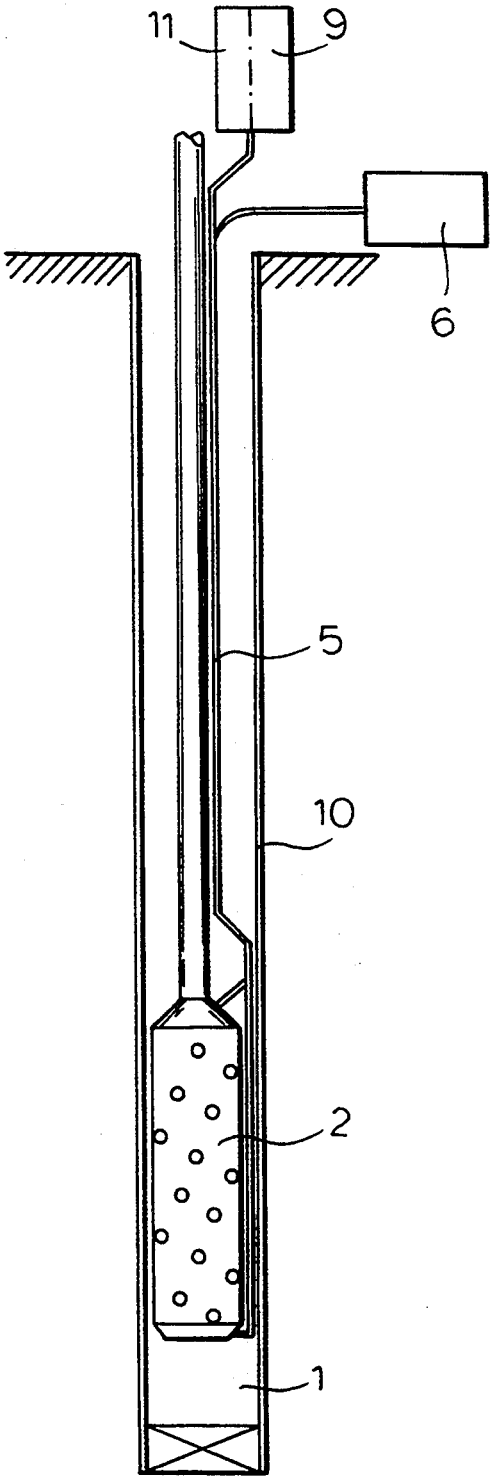
FIG. 6 is a simplified vertical cross section of a fifth embodiment of a detonation system in accordance with the invention received in a bore hole.

FIG. 6 shows an embodiment in which the fiber optic line 5 is coupled to the explosive device 2 at both upper and lower sections of the explosive device 2. This allows the explosive device to be detonated at two separate locations. Similarly optical splitters are used to couple the laser light to the two junctions. It may be advisable to use more than one way of detonating a particular explosive device, for example by using two or more separate lines. This is a precaution in case one or more of the lines failed or for some reason did not function. The explosive device can still be detonated by the remaining good line or lines. This is known as redundant firing.

Figure 7:
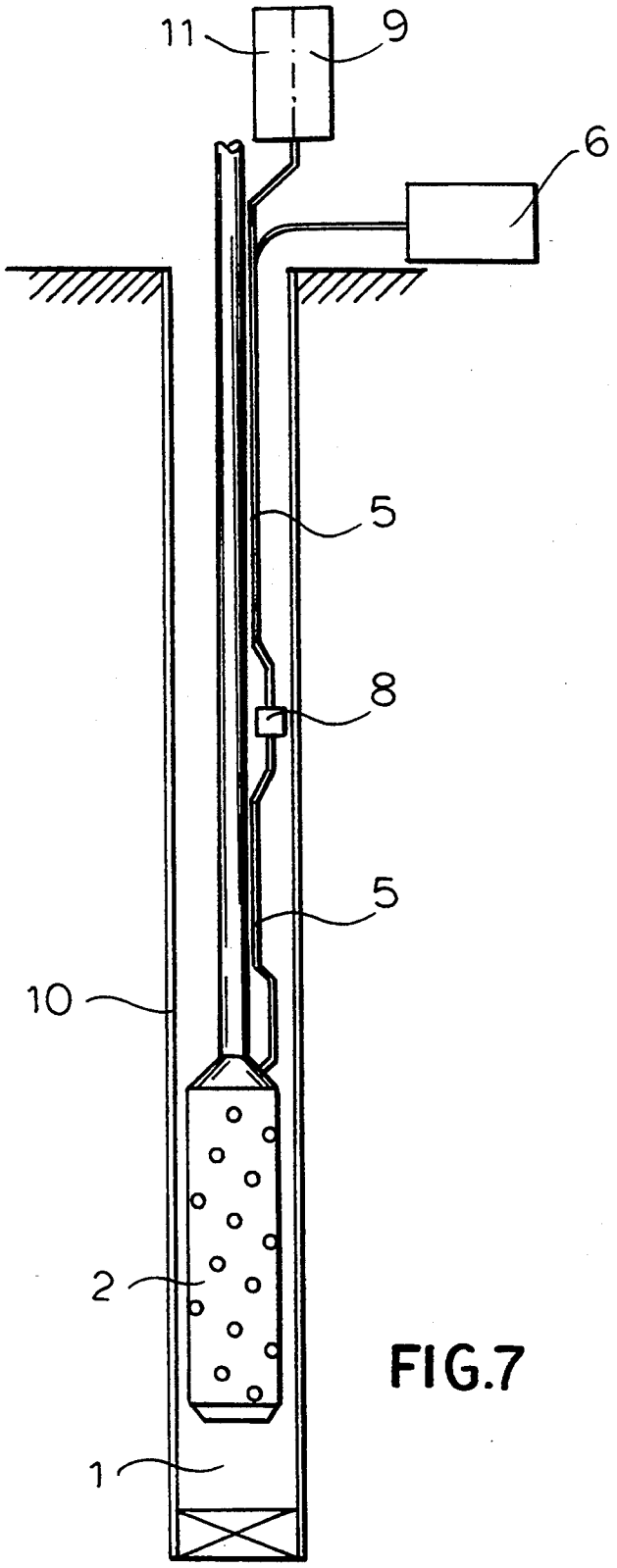
FIG. 7 is a simplified vertical cross section of a sixth embodiment of a detonation system in accordance with the invention received in a bore hole.

FIG. 7 shows an embodiment in which the fiber optic line 5 is provided with an intermediate laser 8 positioned at a certain point along the length of the fiber optic line 5. The intermediate laser 8 is triggered by light from the first firing laser 6 by means a photocell (not shown). The intermediate laser 8 further comprises a capacitor(-not shown) and a discharge circuit. When the photocell detects a signal from the firing laser 6, the firing laser 6 triggers the intermediate laser 8 to release power the capacitor to pump the intermediate laser 8 to release a further laser pulse to detonate the explosive device 2. The capacitor can be recharged as required by a continuous wave from the firing laser 6. It is advantageous to locate the intermediate laser 8 as close to the explosive device 2 as possible. This is particularly the case when there is a large distance between the surface laser and the explosive device because it will be necessary to take account of unpredictable losses of power occurring over large distances. More than one intermediate laser can be used.

Often explosive devices are placed in series with the detonation of one device required before the subsequent device is detonated. Detection of the detonation of the last device, i.e. of the last shot, therefore serves as a check that all the devices have been detonated, i.e. that the series of explosions is complete. This is called shot detection.

Shot detection may be achieved by two methods. The first is a direct method by detection of the flash which is emitted from the detonator after the initial light pulse is sent to detonate the explosion and is transmitted back up the fiber optic cable. With appropriate instrumentation this delayed signal can be measured and recorded at the surface as an indication of detonation. This method is suitable for both top and bottom detonation.

Shot detection can also, be achieved indirectly whereby a signal can be sent down to the device to be detonated and which is reflected back if there is no detonation or not reflected back if there is a detonation. Several embodiments of this principle are possible, for example, i) two or more reflectors which reflect light at different frequencies can be used to indicate where different parts of the system have detonated.

ii) a fibre optic sensor other than a reflector can be used with the sensors being read by a technique such as time division multiplexing.

iii) a device could be arranged which changes the reflector or sensor to a different type when the detonation is detected.

Figure 1:
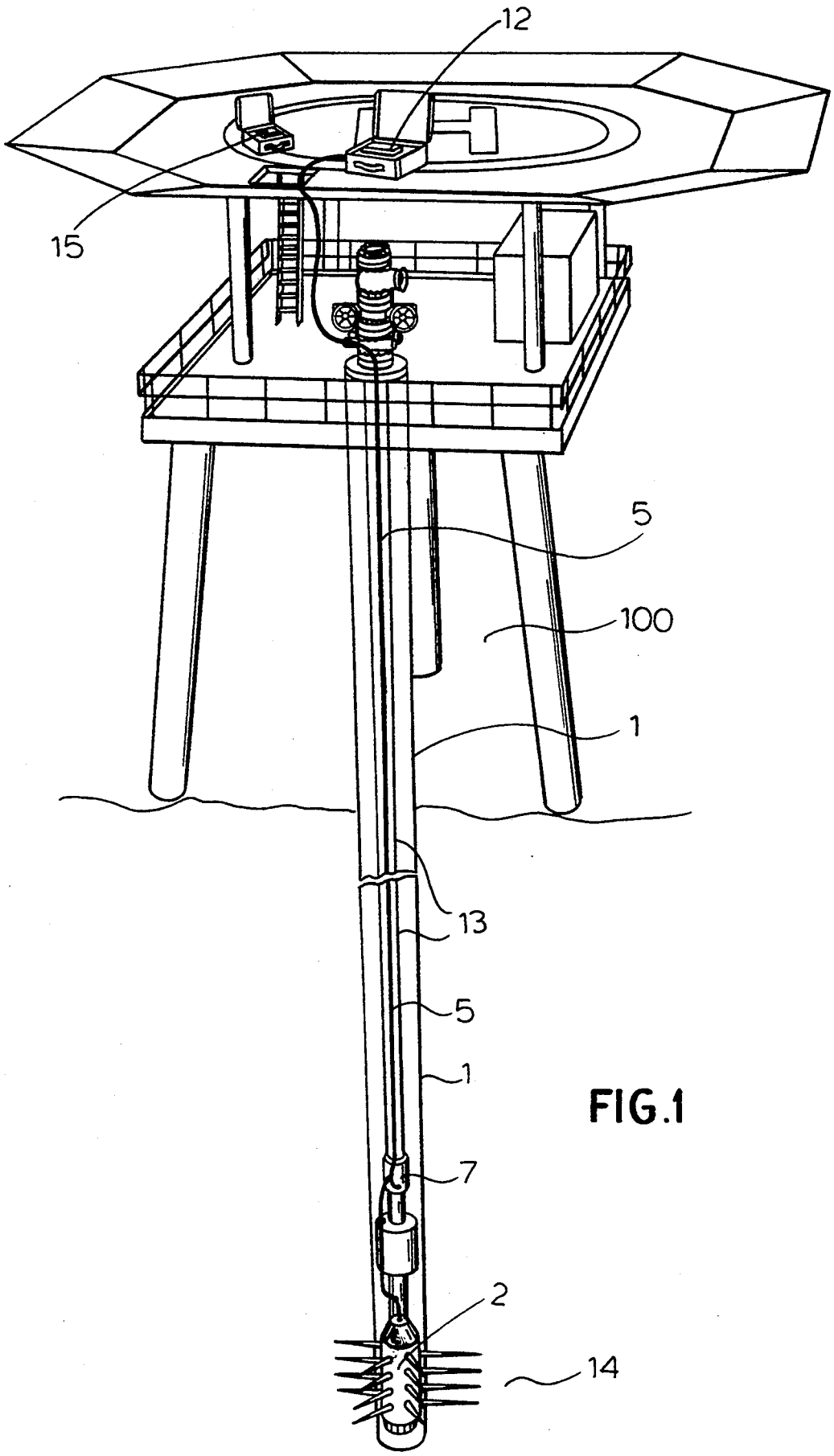
FIG. 1 is a cut away perspective view of an off-shore oil platform, in situ, incorporating a detonation system in accordance with the invention.

FIG. 1 illustrates an embodiment of the detonation system 10 in accordance with the invention integrated with an off-shore oil platform 100. The firing laser 6 and associated electrical and electronic circuitry is contained in a firing station 12, remotely located on the oil platform 100, itself. The fiber optic line 5 is enclosed in tubing 30, and, as described above, is coupled to at least one sensor monitoring the external, environmental parameters of the oil well. The fiber optic line 5 is also coupled to the explosive device 2, also referred to as a perforating gun, located down the bore hole in the reservoir 14 of oil. The lower powered laser 11, the test signal sensor 9, the externally monitored parameter detector and associated circuitry are provided in a testing and monitoring station 15 also remotely located on the platform 100.

It will be obvious to a person skilled in the art that various modifications are possible within the scope of the present invention. For example, other embodiments are possible incorporating several of the embodiments described above, and one or more of the devices described above can be strategically placed in one or more boreholes and connected together to form an explosive and testing system which can be very large and complex.

It will be understood that the invention could be used in any application where a concentrated and controlled source of explosive energy is required.

I claim:

1. A subterranean detonation system comprising:

a well;

at least one detonating means extending below the surface in said well which comprises exclusively secondary explosives and operable to detonate in response to a first predetermined optical signal;

a first optical signal emission means above the surface and which has a power rating in the range of 0.8 to 5 Joules and which is operable to provide the first predetermined optical signal;

transmission means coupled to the detonating means and the first optical signal emission means for transmitting the first predetermined optical signal to the detonating means to actuate detonation of the detonating means; and a sensor which senses that the detonation has occurred, the transmission means including means for transmitting an optical signal to the surface signalling that the detonation has occurred.

2. A subterranean detonating system according to claim 1, further comprising:

a second optical signal emission means coupled to the transmission means and operable to provide a second predetermined optical signal for coupling to the transmission means; and sensing means coupled to the transmission means and operable to sense the second predetermined optical signal;

the transmission means being coupled to the detonating means via means operable to transmit the first predetermined optical signal and to reflect the second predetermined optical signal, the second predetermined optical signal being coupled in the absence of a fault in the transmission means, via the transmission means to the sensing means thus indicating the integrity of the transmission means.

3. A subterranean detonating system according to claim 1 wherein a multiplicity of detonation means are coupled in parallel to the transmission means.

4. A subterranean detonating system according to claim 1 wherein a multiplicity of detonation means are coupled in series to the transmission means.

5. A subterranean detonating system according to claim 1 wherein the transmission means is coupled to the detonation means at a single location on the detonating means.

6. A subterranean detonating system according to claim 1 wherein the transmission means is coupled to the detonation means at two separate locations on the detonating means.

7. A subterranean detonating system according to claim 2 wherein the first optical signal emission means is a laser operable to provide the predetermined first optical signal at a predetermined energy level and frequency.

8. A subterranean detonating system according to claim 7 wherein the second optical signal emission means is a laser operable to provide the second predetermined optical signal at a predetermined energy level lower than operable energy level of the first optical signal emission means and at a different frequency.

9. A subterranean detonating system according to claim 1 wherein the transmission means is an optical fiber.

10. A subterranean detonating system according to claim 2 wherein the means operable to transmit and reflect is an optical splitter.

11. A subterranean detonating system according to claim 1, further comprising at least one second sensing means coupled to the transmission means for monitoring at least one operating program for a detonation system environment and operable to provide a signal indicative of the status of at least one operating parameter to the transmission means to as remotely located monitoring station.

12. A subterranean detonating system according to claim 1 wherein the first optical emission means is coupled to the transmitting means at a point intermediate the length of the transmission means and is operable to provide the first predetermined optical signal in response to an initiation signal from a laser provided at one end of the transmission means remote from the detonating means.

13. A subterranean detonating system according to claim 1 wherein the first optical signal emission means is provided at one end of the transmission means remote from the detonating means.

14. A subterranean detonating system according to claim 2 wherein the second optical signal emission means is provided at one end of the transmission means remote from the detonating means.

15. A subterranean detonating system comprising a fiber optic transmission means and at least one sensing means coupled to a detonating means for monitoring the detonation of the detonating means and operable to provide a signal indicative status of the detonation to the fiber optic transmission means to a remotely located monitoring station.

* * * * *